US012420160B2

(12) United States Patent
Gao

(10) Patent No.: US 12,420,160 B2
(45) Date of Patent: Sep. 23, 2025

(54) PUNCHING BAG

(71) Applicant: LinYi AiBeiJian Sports Goods Co., Ltd., Linyi (CN)

(72) Inventor: Huijin Gao, Linyi (CN)

(73) Assignee: Yuling Bai, Linyi (CN)

( * ) Notice: Subject to any disclaimer, the term of this patent is extended or adjusted under 35 U.S.C. 154(b) by 85 days.

(21) Appl. No.: 18/403,772

(22) Filed: Jan. 4, 2024

(65) Prior Publication Data

US 2025/0213950 A1 Jul. 3, 2025

(30) Foreign Application Priority Data

Dec. 28, 2023 (CN) ..... 202323605525.1

(51) Int. Cl.
*A63B 69/32* (2006.01)
*A63B 24/00* (2006.01)

(52) U.S. Cl.
CPC ..... *A63B 69/32* (2013.01); *A63B 24/0075* (2013.01); *A63B 24/0087* (2013.01)

(58) Field of Classification Search
CPC .. A63B 69/32; A63B 24/0075; A63B 24/0087
See application file for complete search history.

(56) References Cited

U.S. PATENT DOCUMENTS 4,103,889 A * 8/1978 Lobur ..... A63B 69/305 273/DIG. 20
6,090,018 A * 7/2000 Laudenslager ..... A63B 69/305 482/90
6,790,167 B1 * 9/2004 Carlin ..... A63B 69/224 482/90
9,586,120 B1 * 3/2017 Sotelo ..... A63B 69/305
11,198,050 B1 * 12/2021 Moran ..... A63B 71/0622
11,213,733 B1 * 1/2022 Morin ..... A63F 13/428
2004/0097348 A1 * 5/2004 Laudenslager ..... A63B 69/305 482/86
2007/0099772 A1 * 5/2007 Fu ..... A63B 69/305 482/83
2008/0032872 A1 * 2/2008 Nappier ..... A63B 69/305 482/83

(Continued)

FOREIGN PATENT DOCUMENTS

WO WO-2005068028 A1 * 7/2005 ..... A63B 24/0021

*Primary Examiner* — Sundhara M Ganesan
(74) *Attorney, Agent, or Firm* — MATTHIAS SCHOLL P.C.; Matthias Scholl

(57) ABSTRACT

A punching bag including: a main body module and a plurality of digital display modules. The main body module includes a cylinder body, a pillar, and a flange. The cylinder body includes a first member and a second member. The first member includes an upper part and a lower part integrated with the upper part. The upper part is cylindrical and the lower part is semicylindrical. The upper part includes a central axial hole. The lower part includes a first rectangular surface and a first axial semicircular groove disposed in the middle of the first rectangular surface. The first axial semicircular groove extends to communicate with the central axial hole of the upper part. The second member is semicylindrical, and includes a second rectangular surface and a second axial semicircular groove disposed in a middle of the second rectangular surface.

6 Claims, 4 Drawing Sheets

(56) References Cited

U.S. PATENT DOCUMENTS

2008/0096733 A1* 4/2008 Epstein ..... A63B 69/305 482/83
2008/0260299 A1* 10/2008 Ng ..... A63B 69/32 383/3
2009/0048069 A1* 2/2009 Sheedy ..... A63B 24/0006 482/8
2010/0261584 A1* 10/2010 Tsakiris ..... A63B 69/305 482/86
2011/0015040 A1* 1/2011 Fleitz ..... A63B 69/322 482/84
2011/0111928 A1* 5/2011 Tsakiris ..... A63B 69/305 482/87
2012/0149534 A1* 6/2012 Fu ..... A63B 69/22 482/90
2012/0238407 A1* 9/2012 Dilworth ..... A61B 5/6895 482/8
2013/0331235 A1* 12/2013 Fields ..... A63B 69/22 482/83
2014/0128226 A1* 5/2014 Chang ..... A63B 69/22 482/83
2014/0206504 A1* 7/2014 Barreras ..... A63B 69/32 482/8
2014/0221129 A1* 8/2014 Chen ..... A63B 69/224 473/422
2014/0226919 A1* 8/2014 Fu ..... A63B 69/20 383/3
2014/0366645 A1* 12/2014 Tsai ..... G01L 5/0052 73/862.041
2015/0011365 A1* 1/2015 Nelson ..... A63B 24/0087 482/84
2015/0094191 A1* 4/2015 Fradin ..... A63B 71/0622 482/8
2015/0273306 A1* 10/2015 Fu ..... A63B 21/4035 482/87
2015/0352423 A1* 12/2015 Almeras ..... A63B 69/305 482/89
2016/0059102 A1* 3/2016 Williamson ..... A63B 69/32 482/8
2017/0036087 A1* 2/2017 Codrington ..... B32B 9/025
2018/0001176 A1* 1/2018 Siklosi ..... F16B 1/00
2020/0101362 A1* 4/2020 Adkisson ..... A63B 69/34
2020/0391091 A1* 12/2020 Lei ..... A63B 69/224
2021/0178241 A1* 6/2021 Jones ..... A63B 69/322
2021/0283482 A1* 9/2021 Wu ..... A63B 69/20
2021/0346746 A1* 11/2021 Nguyen ..... A63B 9/00
2022/0134204 A1* 5/2022 Raco ..... A63B 69/224 482/86
2023/0285826 A1* 9/2023 Cranke ..... A63B 69/20
2023/0285827 A1* 9/2023 Grendal ..... A63B 71/145
2023/0356053 A1* 11/2023 Sobotka ..... A63B 69/305
2024/0252901 A1* 8/2024 Roditis ..... A63B 69/22
2024/0390760 A1* 11/2024 Jawaid ..... A63B 69/222
2024/0424373 A1* 12/2024 Merrell ..... G01L 5/0052

* cited by examiner

PUNCHING BAG

CROSS-REFERENCE TO RELATED APPLICATIONS

Pursuant to 35 U.S.C. § 119 and the Paris Convention Treaty, this application claims foreign priority to Chinese Patent Application No. 202323605525.1 filed Dec. 28, 2023, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to the field of boxing devices, and more particularly to a punching bag.

Conventional punching bags are filled with rags or other industrial trimmings, and generally include two parts: the upper practicing body and the lower counterweight base, which are packed into two parcels for transportation and storage. The parcels are bulkier than necessary, not easy to pass the entrances of the supermarkets and warehouses, and thus are not conducive to the marketing of products. In addition, conventional punching bags have a sole function, that is, just for physical boxing training, do not have means for encouraging practice.

SUMMARY

The disclosure provides a punching bag, comprising: a main body module; and a plurality of digital display modules.

The main body module is a modularized body for boxing training, and comprises a cylinder body, a pillar, and a flange; the cylinder body comprises a first member and a second member; the first member comprises an upper part and a lower part integrated with the upper part; the upper part is cylindrical and the lower part is semicylindrical; the upper part comprises a central axial hole; the lower part comprises a first rectangular surface and a first axial semicircular groove disposed in a middle of the first rectangular surface; the first axial semicircular groove extends to communicate with the central axial hole of the upper part; diameters of the first axial semicircular groove and the central axial hole correspond to a diameter of the pillar; the second member is semicylindrical, and comprises a second rectangular surface and a second axial semicircular groove disposed in a middle of the second rectangular surface; a diameter of the second axial semicircular groove corresponds to the diameter of the pillar; the first member is in embedded connection to the second member to form the cylinder body; the first axial semicircular groove cooperates with the second axial semicircular groove to form an axial hole to receive the pillar; the cylinder body is supported by the flange and locked by the pillar; the main body module further comprises a buffer layer and an outer layer; the buffer layer is disposed between the cylinder body and the outer layer; a counterweight base is fixed on one end of the pillar; the buffer layer comprises a plurality of grooves, and the plurality of digital display modules are embedded in the plurality of grooves, respectively;

the plurality of digital display modules each comprise a touchscreen cover, a chip, a base plate, a light-emitting diode, and a pressure sensor; the chip comprises a front side and a back side, and the light-emitting diode is disposed on the front side and the pressure sensor is disposed on the back side; the touchscreen cover comprises a curved outer surface and translucent resilience material; the touchscreen cover further comprises a thickened center part comprising a plurality of dents; the touchscreen cover is attached to the base plate through an adhesive; the chip is connected to the digital control panel through a lead wire; an adapter sleeve is disposed on a back side of the digital control panel and sleeves the pillar.

In a class of this embodiment, the pressure sensor is a three-contact structure; a joint of the chip and the touchscreen cover and four contact corners of the chip and the base plate are provided with locating holes and locating pins; and a reinforcing rib is disposed on a back side of the base plate.

In a class of this embodiment, the cylinder body is a molded resilient structure or a container structure comprising a filler; the container structure is blow molded; the first member comprises a first top end comprising a first filling opening; and the second member comprises a second top end comprising a second filling opening.

In a class of this embodiment, an embedded part is disposed on an outer surface of a joint of the first member and the second member; the embedded part is a concave platform comprising connecting holes; and screws pass through the connecting holes to fixedly connect the first member and the second member.

In a class of this embodiment, a recess is disposed on a bottom of the upper part of the first member, and the second filling opening of the second member is located in the recess; and a vertical height ratio of the first member to the second member is 2:1.

In a class of this embodiment, a fixed bar and a non-skid tape are disposed on the pillar; the fixed bar is disposed at a lower part of a top end of the pillar, and the top end of the pillar is embedded in the central axial hole; and two ends of the fixed bar are disposed on a top side of the first rectangular surface of the first member.

The following advantages are associated with the punching bag of the disclosure:

1. The punching bag of the disclosure adopts a combination structure of a cylinder body, a buffer layer, and an outer layer. The main body module of the punching bag is divided into several parts, which is convenient for independent packaging and storage. The packaging is light, easy to move, transport, and store, which is conducive to the circulation of the product. The parts are easy to take out for assembly, and the assembly can be completed through simple operations, improving the efficiency.

2. The punching bag comprises a plurality of digital display modules comprising a light-emitting diode and a pressure sensor, to sense and display the hitting position, collect hitting speed and force data, and display the information on the digital control panel, supplemented by voice prompts, broadcasts, and programmable settings, to help users establish correct reaction ability, enhance real-time feedback interactivity, increase the fun of fighting training, and bring new vitality to the punching bags, a traditional sports product.

Figure 1:
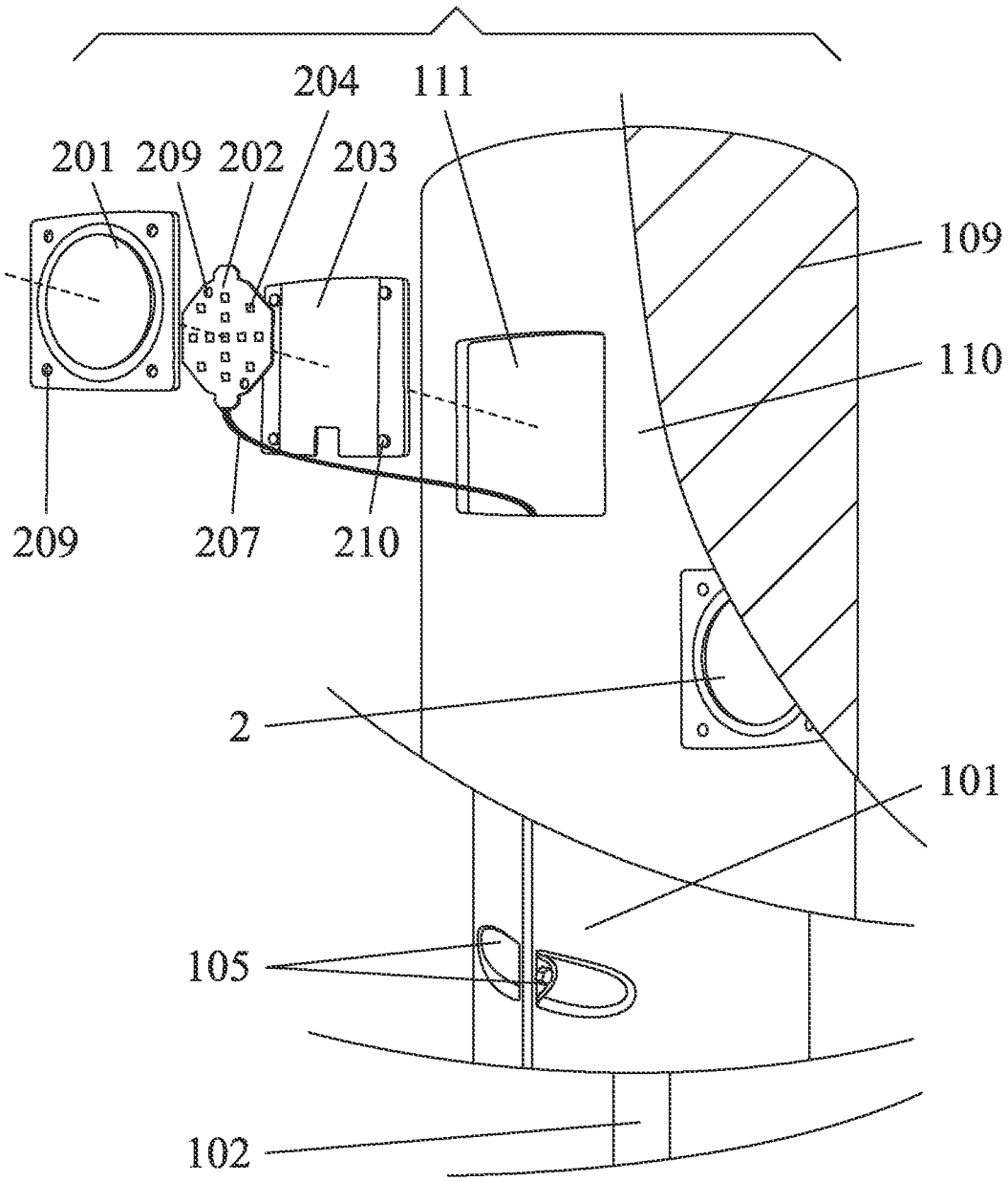
FIG. 1 is an exploded view of a modularized body for boxing training according to one embodiment of the disclosure.
Figure 2:
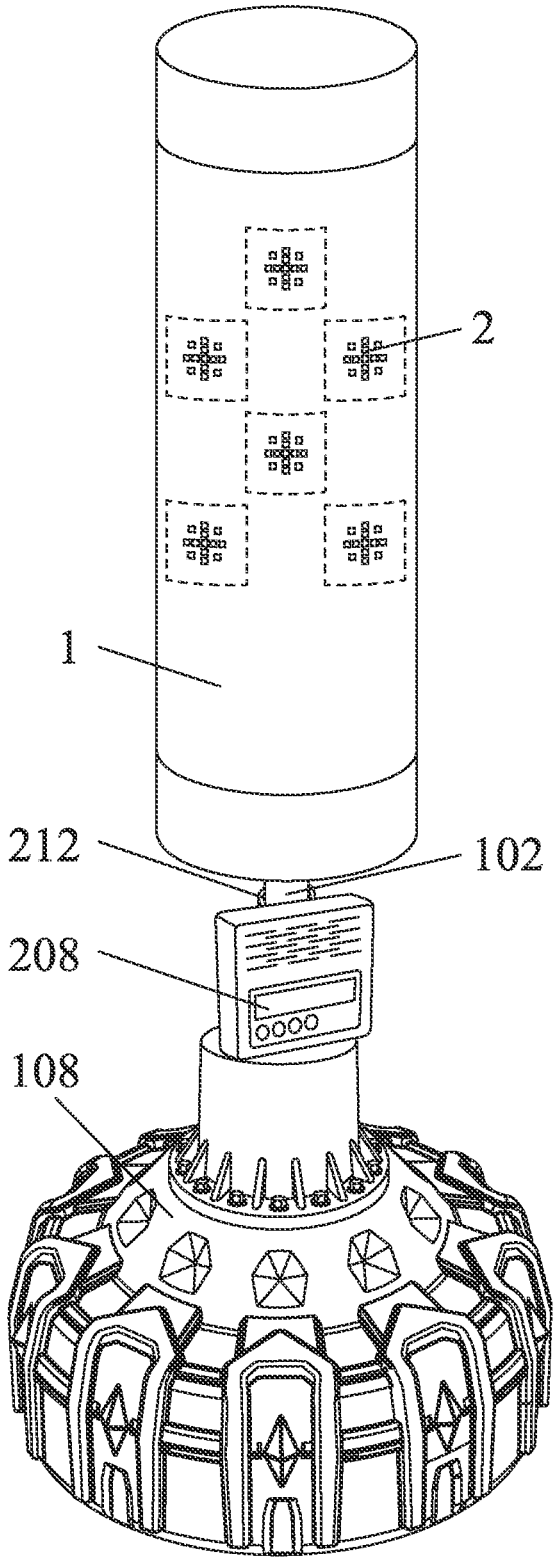
FIG. 2 is a schematic diagram of a modularized body for boxing training according to one embodiment of the disclosure.

In the drawings, the following reference numbers are used: 1. Main body module; 101. Cylinder body; 1011. First member; 1012. Second member; 102. Pillar; 103. Flange; 1041. First semicircular groove; 1042. Second semicircular groove; 105. Embedded part; 1061. First filling opening; 1062. Second filling opening; 107. Recess; 108. Counterweight base; 109. Outer layer; 110. Buffer layer; 111. Groove; 112. Fixed bar; 113. Non-skid tape; 114. Central axial hole; 2. Digital display module; 201. Touchscreen cover; 202. Chip; 203. Base plate; 204. Light-emitting diode; 205. Pressure sensor; 206. Dent; 207. Lead wire; 208. Digital control panel; 209. Locating hole; 210. Locating pin; 211. Reinforcing rib; 212. Adapter sleeve.

DETAILED DESCRIPTION

To further illustrate the disclosure, embodiments detailing a punching bag are described below. It should be noted that the following embodiments are intended to describe and not to limit the disclosure.

As shown in FIGS. 1-5, the disclosure provides a punching bag comprising a main body module 1 and a plurality of digital display modules 2. The main body module 1 is a modularized body for boxing training, and comprises a cylinder body 101, a pillar 102, and a flange 103. The cylinder body 101 comprises a first member 1011 and a second member 1012; the first member 1011 comprises an upper part and a lower part integrated with the upper part; the upper part is cylindrical and the lower part is semicylindrical; the upper part comprises a central axial hole 114; the lower part comprises a first rectangular surface and a first axial semicircular groove 1041 disposed in a middle of the first rectangular surface; the first axial semicircular groove extends to communicate with the central axial hole 114 of the upper part; diameters of the first axial semicircular groove 1041 and the central axial hole 114 correspond to a diameter of the pillar 102; the second member 1012 is semicylindrical, and comprises a second rectangular surface and a second axial semicircular groove 1042 disposed in a middle of the second rectangular surface; a diameter of the second axial semicircular groove 1042 corresponds to the diameter of the pillar 102; the first member 1011 is in embedded connection to the second member 1012 to form the cylinder body; the first axial semicircular groove 1041 cooperates with the second axial semicircular groove 1042 to form an axial hole to receive the pillar 102; the cylinder body 101 is supported by the flange 103 and locked by the pillar 102, to form the inner core of the punching bag; the main body module 1 further comprises a buffer layer 110 and an outer layer 109; the buffer layer 110 is disposed between the cylinder body 101 and the outer layer 109, which form the main body of the punching bag; the outer layer 109 is a transparent and resilient material. A counterweight base 108 is fixed on one end of the pillar 102; the buffer layer 110 comprises a plurality of grooves 111, and the plurality of digital display modules 2 are embedded in the plurality of grooves 111, respectively.

The plurality of digital display modules 2 each comprise a touchscreen cover 201, a chip 202, a base plate 203, a light-emitting diode 204, and a pressure sensor 205; the chip 202 comprises a front side and a back side, and the light-emitting diode 204 is disposed on the front side and the pressure sensor 205 is disposed on the back side; the light-emitting diode 204 comprises a plurality of emitting monomers arranged in a matrix; the touchscreen cover 201 comprises a curved outer surface and translucent resilience material, which corresponds to the curvature of the cylindrical surface of the punching bag, and plays a buffering role. The touchscreen cover 201 further comprises a thickened center part comprising a plurality of dents 206 corresponding to the emitting monomers of the light-emitting diode, to transmit the light through the dents 206 and the outer layer 109. The edge of the touchscreen cover 201 is slightly thinner, forming an automatically rebounded physical structure by touch pressure. The touchscreen cover 201 is attached to the base plate 203 through an adhesive, improving the firmness. The chip 202 is connected to the digital control panel 208 through a lead wire 207; an adapter sleeve 212 is disposed on a back side of the digital control panel 208 and sleeves the pillar 102. The diameter of the hole of the adapter sleeve 212 is corresponding to that of the pillar 102.

Figure 3:
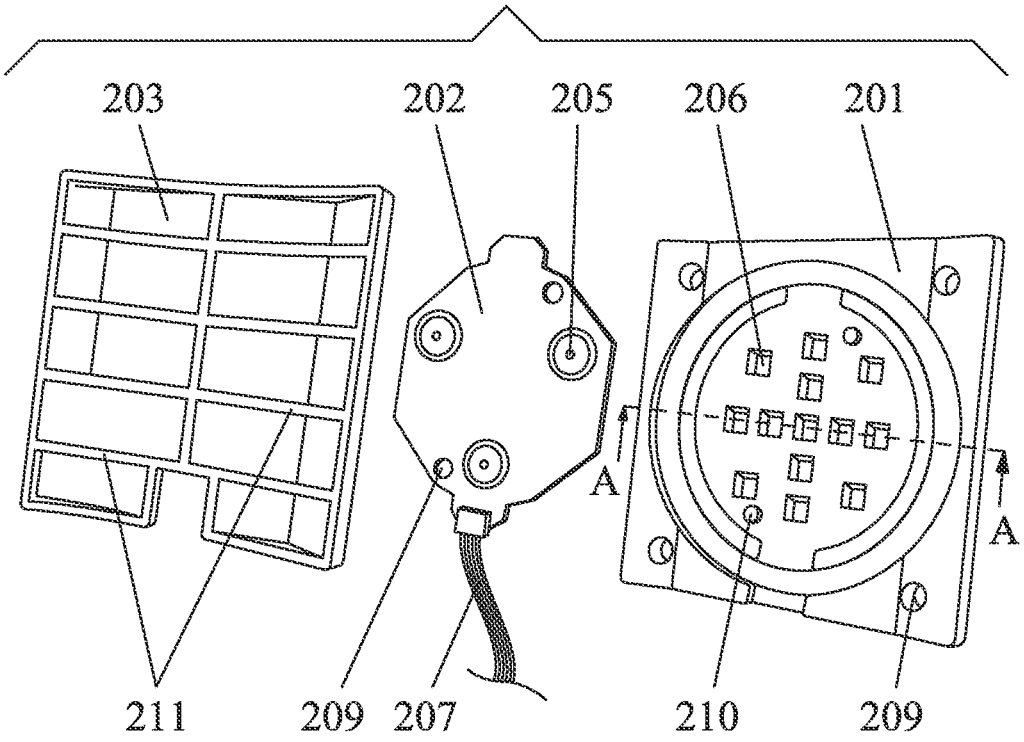
FIG. 3 is an exploded view of a digital display module according to one embodiment of the disclosure.
Figure 4:
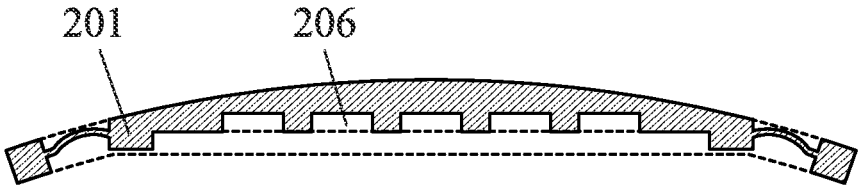
FIG. 4 is a sectional view taken from line A-A in FIG. 3.
Figure 5:
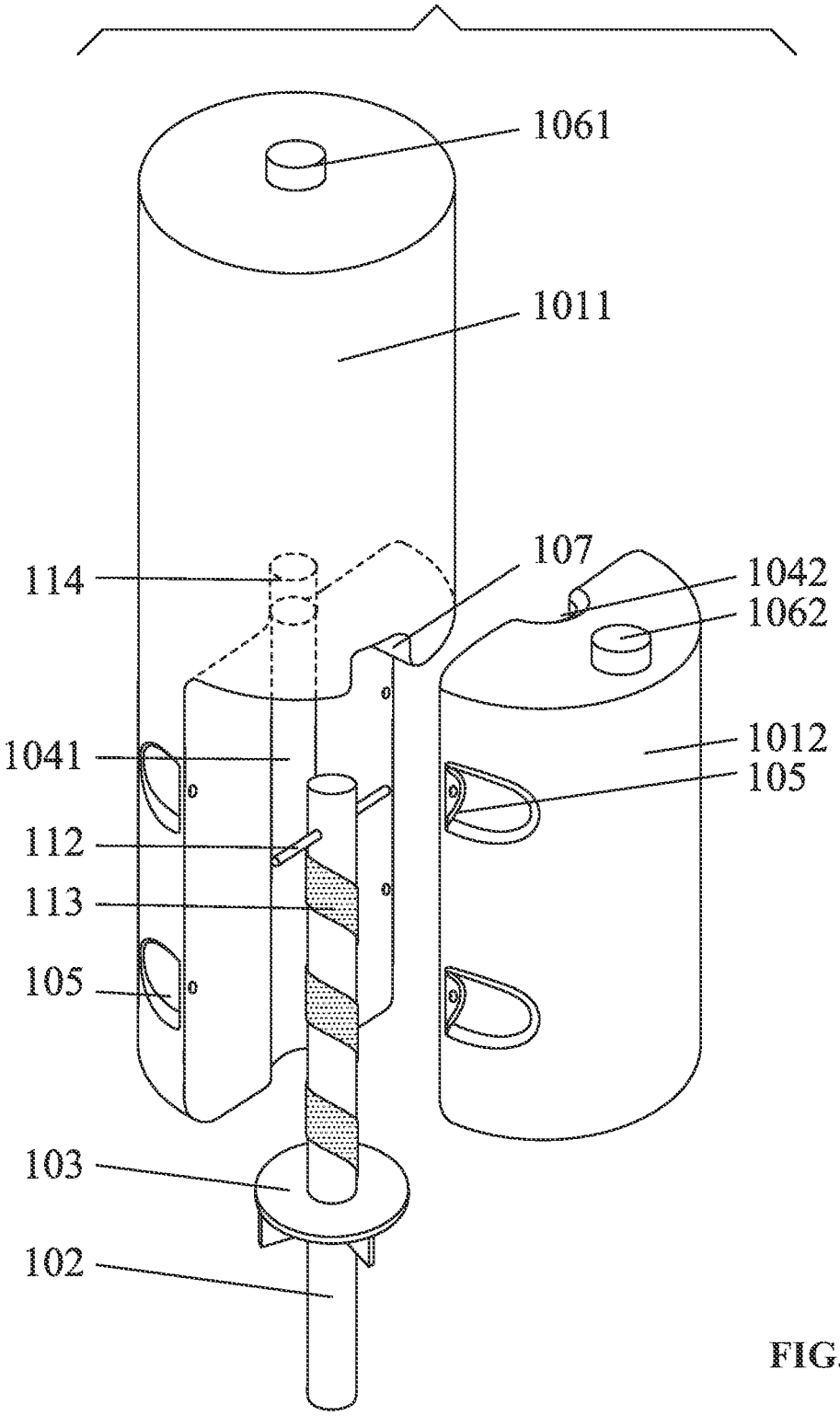
FIG. 5 is a schematic diagram of a main body module according to one embodiment of the disclosure.

In certain embodiments, as shown in FIG. 3, the pressure sensor 205 is a three-contact structure, thus improving the sensitivity and stability of the stress; the joint of the chip 202 and the touchscreen cover 201 and four contact corners of the chip 202 and the base plate 203 are provided with locating holes 209 and locating pins 210, to form a positioning effect and prevent deviation during impact; and a reinforcing rib 211 is disposed on a back side of the base plate 203, to play a pressure bearing role in boxing training.

In certain embodiments, the cylinder body 101 is a molded resilient structure or a container structure comprising a filler; the container structure is blow molded; the first member 1011 comprises a first top end comprising a first filling opening 1061; and the second member 1012 comprises a second top end comprising a second filling opening 1062.

In certain embodiments, an embedded part 105 is disposed on an outer surface of a joint of the first member 1011 and the second member 1012; the embedded part 105 is a concave platform comprising connecting holes; and screws pass through the connecting holes to fixedly connect the first member and the second member, thus preventing the displacement of the cylinder body 101 in the boxing training and exercising.

In certain embodiments, a recess 107 is disposed on a bottom of the upper part of the first member 1011, and the second filling opening 1062 of the second member is located in the recess; and a vertical height ratio of the first member 1011 to the second member 1012 is 2:1.

In certain embodiments, a fixed bar 112 and a non-skid tape 113 are disposed on the pillar 102; the fixed bar 112 is disposed at a lower part of a top end of the pillar 102, and the top end of the pillar 102 is embedded in the central axial hole 114; and two ends of the fixed bar 112 are disposed on the top side of the first rectangular surface of the first member 1011, to support the main body of the punching bag and enhance stability. The non-skid tape 113 comprises materials with high friction coefficients to enhance the connection stability between the cylinder body 101 and the pillar 102.

Storing and assembling: when storing, the cylinder body 101, the pillar 102, the flange 103, and the buffer layer 110, the outer layer 109, the counterweight base 108 are independently packed, which is convenient transportation, and easy to take out for assembly. During assembly, the first semicircular groove 1041 of the first member 1011 and the second semicircular groove 1042 of the second member 1012 are combined to surround the pillar 102 and the cylinder body is formed. The bottom of the cylinder body is supported by the flange 103, preventing the falling. When the cylinder body 101 is a container structure, to increase the weight, water is filled through the first filling opening 1061 and the second filling opening 1062 into the cylinder. Optionally, the cylinder body is empty. The buffer layer 110 covers the outer surface of the cylinder body 101, and the plurality of digital display modules are respectively embedded in corresponding grooves 111 of the buffer layer 110. The outer layer 109 encloses the buffer layer, to form the main body of the punching bag. The counterweight materials such as sand and gravel are loaded into the counterweight base 108, or the counterweight base 108 is fixed on the ground through the negative pressure produced by the suction cup at the bottom of the counterweight base 108. The lead wire 207 of the digital display module 2 is connected to the digital control panel 208. The pillar 102 passes through the hollow tube of the adapter sleeve 212 behind the back side of the digital control panel 208, and then the main body of the punching bag is disposed on the counterweight base 108.

When in use, the punching bag is powered on and enters a preset operating mode under the control of the digital control panel 208. The LED light of the digital display module 2 on the surface of the punching bag lights up, and the user hits the lighted part. Thus, the pressure sensor 205 is activated. The digital control panel 208 then broadcasts voice feedback and prompts the target through the LED light. Through the cooperation of the LED light on the chip 202, the pressure sensor 205, and the display screen of the digital control panel 208, the punching feedback is instantly produced. In addition, the boxing training and feedback can be connected to terminals such as mobile phones, thus achieving multimedia control, with dual attributes of boxing training and entertainment.

It will be obvious to those skilled in the art that changes and modifications may be made, and therefore, the aim in the appended claims is to cover all such changes and modifications.

The invention claimed is:

1. A punching bag, comprising:

a main body module; and a plurality of digital display modules;

wherein:

the main body module is a modularized body for boxing training, and comprises a cylinder body, a pillar, and a flange;

the cylinder body comprises a first member and a second member;

the first member comprises an upper part and a lower part integrated with the upper part; the upper part is cylindrical and the lower part is semicylindrical; the upper part comprises a central axial hole; the lower part comprises a first rectangular surface and a first axial semicircular groove disposed in a middle of the first rectangular surface; the first axial semicircular groove extends to communicate with the central axial hole of the upper part; diameters of the first axial semicircular groove and the central axial hole correspond to a diameter of the pillar;

the second member is semicylindrical, and comprises a second rectangular surface and a second axial semicircular groove disposed in a middle of the second rectangular surface; a diameter of the second axial semicircular groove corresponds to the diameter of the pillar;

the first member is in embedded connection to the second member to form the cylinder body; the first axial semicircular groove cooperates with the second axial semicircular groove to form an axial hole to receive the pillar;

the cylinder body is supported by the flange and locked by the pillar;

the main body module further comprises a buffer layer and an outer layer; the buffer layer is disposed between the cylinder body and the outer layer; a counterweight base is fixed on one end of the pillar; the buffer layer comprises a plurality of grooves, and the plurality of digital display modules are embedded in the plurality of grooves, respectively; and each of the plurality of digital display modules comprise a touchscreen cover, a chip, a base plate, a light-emitting diode, and a pressure sensor; the chip comprises a front side and a back side, and the light-emitting diode is disposed on the front side and the pressure sensor is disposed on the back side; the touchscreen cover comprises a curved outer surface and translucent resilience material; the touchscreen cover further comprises a thickened center part comprising a plurality of dents; the touchscreen cover is attached to the base plate through an adhesive; the chip is connected to the digital control panel through a lead wire; an adapter sleeve is disposed on a back side of the digital control panel and sleeves the pillar.

2. The punching bag of claim 1, wherein the pressure sensor is a three-contact structure; a joint of the chip and the touchscreen cover and four contact corners of the chip and the base plate are provided with locating holes and locating pins; and a reinforcing rib is disposed on a back side of the base plate.

3. The punching bag of claim 1, wherein the cylinder body is a molded resilient structure or a container structure comprising a filler; the container structure is blow molded; the first member comprises a first top end comprising a first filling opening; and the second member comprises a second top end comprising a second filling opening.

4. The punching bag of claim 1, wherein an embedded part is disposed on an outer surface of a joint of the first member and the second member; the embedded part is a concave platform comprising connecting holes; and screws pass through the connecting holes to fixedly connect the first member and the second member.

5. The punching bag of claim 3, wherein a recess is disposed on a bottom of the upper part of the first member, and the second filling opening of the second member is located in the recess; and a vertical height ratio of the first member to the second member is 2:1.

6. The punching bag of claim 1, wherein a fixed bar and a non-skid tape are disposed on the pillar; the fixed bar is disposed at a lower part of a top end of the pillar, and the top end of the pillar is embedded in the central axial hole; and two ends of the fixed bar are disposed on a top side of the first rectangular surface of the first member.

* * * * *